US005624203A

United States Patent [19]

Jackson et al.

[11] Patent Number: 5,624,203

[45] Date of Patent: Apr. 29, 1997

[54] ENERGY ABSORBING BARRIER SYSTEM WITH CRASH INDICATION

[75] Inventors: Martin A. Jackson, Warwick, R.I.; Gerald L. Gorham, Ashby; John M. Rhatigan, Hudson, both of Mass.

[73] Assignee: The Entwistle Company, Hudson, Mass.

[21] Appl. No.: 549,510

[22] Filed: Oct. 27, 1995

[51] Int. Cl.[6] ..... E01F 15/06; B61L 25/00; B60Q 9/00

[52] U.S. Cl. ..... 404/6; 49/9; 49/34; 246/473.1; 340/436; 340/908.1; 340/932.2

[58] Field of Search ..... 404/6; 49/9, 34, 49/49, 404; 246/473.1; 340/436, 437, 548, 590, 665, 668, 905, 908.1, 932.2

[56] References Cited

U.S. PATENT DOCUMENTS

| | | | |
|---|---|---|---|
| 1,929,859 | 10/1933 | Strauss | 49/9 X |
| 2,237,106 | 4/1941 | Minert | 49/9 |
| 2,251,699 | 8/1941 | Banschbach | 49/9 |
| 2,324,726 | 7/1943 | Sawyer | 49/9 X |
| 2,336,483 | 12/1943 | Hoover | 49/9 |
| 2,440,574 | 4/1948 | Cotton | 49/9 X |
| 2,450,328 | 7/1948 | Cotton | 49/9 X |
| 3,887,909 | 6/1975 | Beiswenger et al. | 340/548 X |
| 4,829,287 | 5/1989 | Karr et al. | 340/548 X |
| 5,500,642 | 3/1996 | Battle | 340/436 X |

*Primary Examiner*—Stephen J. Novosad
*Assistant Examiner*—Frederick L. Lagman
*Attorney, Agent, or Firm*—Jerry Cohen

[57] ABSTRACT

A restraining barrier (30) is positionable across a roadway in a deployed position to define a restraining zone and may be moved vertically to a passive position by first and second transport members (13, 14) slideably mounted to first and second towers (3, 4) on either side of the roadway. The barrier may be a rectangular net. First and second cables (34, 35) each support an opposite end of the barrier to the said first and second transport means respectively and also couple the barrier to an energy absorber (known per se). The cable includes a support cable which also responds to the impact of a vehicle as by breaking. The cable is coupled to an operate indicator for producing a signal indicating the vehicle impact.

7 Claims, 5 Drawing Sheets

ENERGY ABSORBING BARRIER SYSTEM WITH CRASH INDICATION

BACKGROUND OF THE INVENTION

The present invention relates to energy absorbing barrier systems and more particularly to such systems including means for producing signals indicative of system status.

Energy absorbing units for arresting the motion of objects or vehicles have found wide application in the past. For example, U.S. Pat. No. 2,980,213 discloses a system in which a hook trailing from a plane that has landed catches a cable extending across a runway. The ends of the cable are connected to energy absorbers. The energy absorbers each includes a coil of metal which absorbs kinetic energy by being plastically deformed beyond its yield point. Travel of the airplane after landing is significantly limited. Other patents disclosing energy absorbing means include U.S. Pat. No. 2,9791163, 3,017,163, 3,211,260 and 3,366,353. All of the aforementioned patents are commonly assigned with this application. Their disclosures are incorporated by reference herein. Such units have also been used for arresting vertical travel of an elevator whose suspension cable may have broken. More recently, such energy absorbers have been incorporated into roadway systems.

Many fatalities due to collision of a train with a vehicle have been avoided by building of automobile underpasses or train bridges so that a road will not cross railroad tracks. However, cost of widespread implementation of such construction is prohibitive. Such construction has been found to be cost justified in densely populated areas, but may still not be done in areas where a large risk may still exist. It is also desirable to improve safety where possible even at remotely located grade crossings. One way has been to a use barrier comprising a net of Kevlar, (aromatic polyamide fibers) metal or other strong material supported between two columns to arrest vehicle movement. When the barrier is in a deployed state, it defines a restraint zone in which a car will engage the net. The net is coupled to energy absorbers which absorb kinetic energy of the car. The barrier can be moved so that it does not block the restraint zone when it is desired to let traffic pass. The energy absorbers generally comprise metal strips that are plastically deformed to absorb kinetic energy and payout at a rate that provides low deceleration of a vehicle, but sufficient to stop a vehicle in a reasonably distance. Therefore, the energy absorbers are not reusable without servicing and replacement of the metal strip. Replacement is required after an incident in which a crash into a barrier (engagement of a vehicle by the barrier) occurs.

Where many grade crossings are each protected by such a system, it is necessary to monitor the status of each system to know when a crash into a barrier has occurred. In populated areas, occurrence of a crash will be conspicuous. In other areas, visual inspection may be necessary. It is helpful if the organization maintaining the grade crossing protection systems can get prompt notification of a change in the status of any of dozens of unmanned systems within a region served by the maintenance organization.

SUMMARY OF THE INVENTION

It is therefore an object of the present invention to provide an energy absorbing barrier system including means for indicating engagement of a vehicle by the barrier.

It is a more specific object of the present invention to provide a system of the type described having a barrier capable of stopping either a car or a truck.

It is a further object of the present invention to provide a system of the type described which possesses substantial immunity to false alarms.

It is another object of the present invention to provide a system of the type described in which complexity is minimized.

Briefly stated, in accordance with the present invention, there is provided a restraining barrier positionable across a roadway in a deployed position to define a restraining zone. The restraining barrier may be moved vertically to a passive position by first and second transport means slidably mounted in first and second towers on either side of the roadway. The barrier may be a metal net and/or an array of parallel or crossing cables. First and second cable means each support an opposite end of the barrier to the said first and second transport means respectively and also couple the barrier means to an energy absorbing unit with a deformable metal tape as the principal energy absorbing means.

The cable means include a support cable which also responds unambiguously to the impact of a vehicle caught by the lowered net. The cable response is a breakage of the cable. When the support cable breaks, activation means are enabled to operate a signal system so that an indication of engagement of a vehicle by the barrier is produced at a distance. Thus, many such systems can be placed at dozens of grade crossings in a region with control by a single headquarters site and no need for manual observation at each such grade crossing.

The indication of crash is preferably made without use of a flexible umbilical cord of signal wires sliding up and down with one or both of the transport means. That is, a fixed signal activation device is provided that has a switch normally restrained from activation by the cable. Breakage of the cable allows activation.

While the invention has been described thus far (and primarily herein) as to grade crossing usage, it is also applicable, e.g. as a security gate, in (temporary) runaway truck runout facilities and the like.

Other objects, features and advantages will be apparent from the following detailed description of preferred embodiments taken in conjunction with the accompanying drawings in which:

DETAILED DESCRIPTION OF PREFERRED EMBODIMENTS

Figure 2:
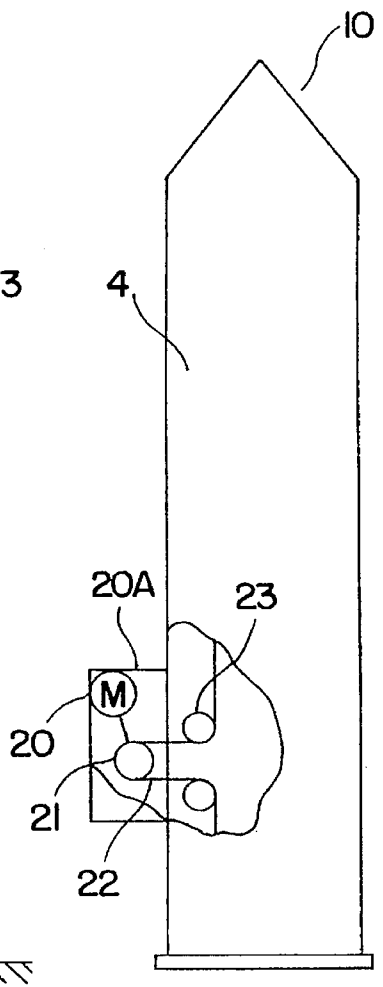
FIG. 2 is a side elevation relative to FIG. 1.
Figure 1:
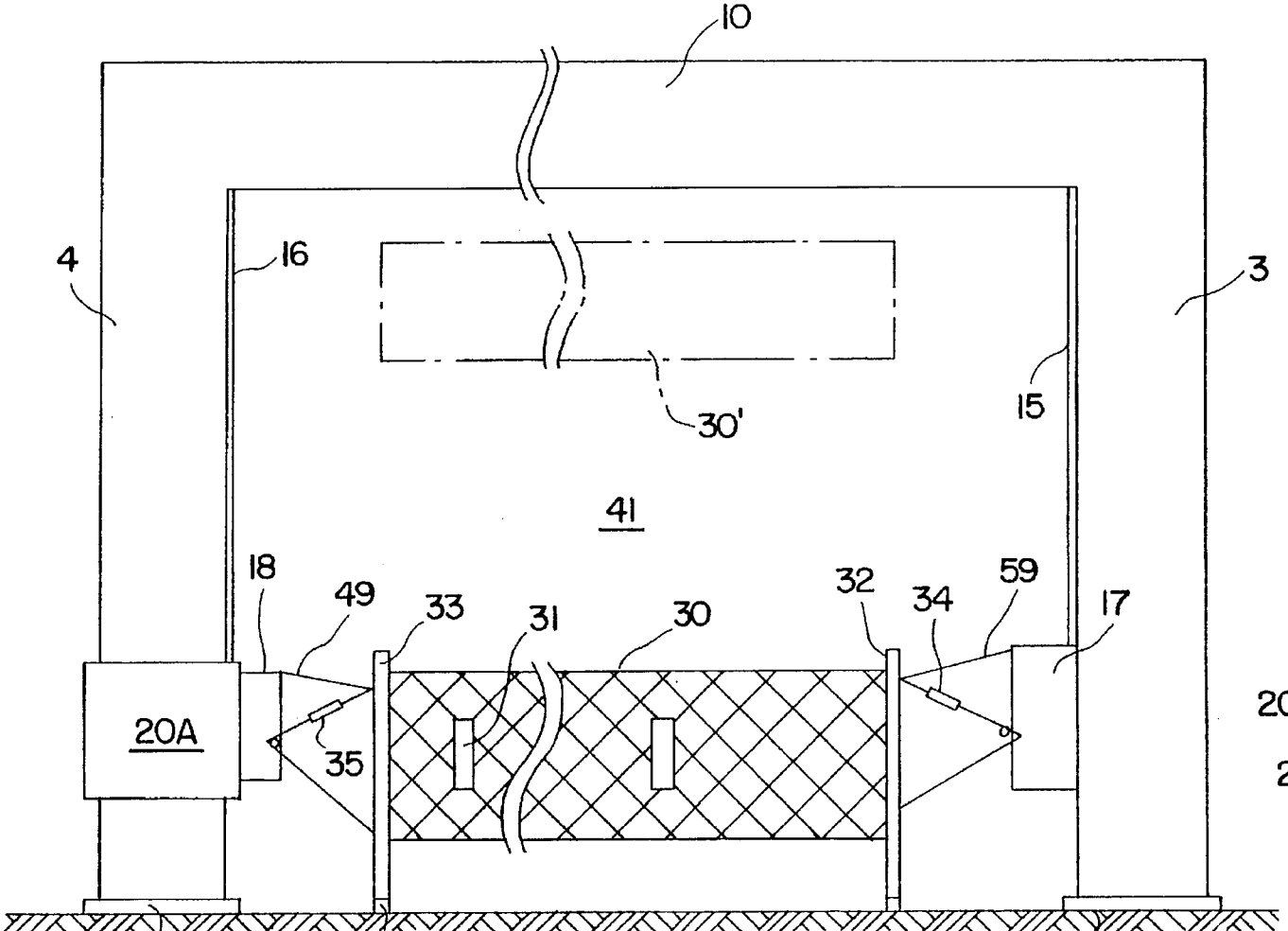
FIG. 1 is a rear elevation of a system constructed in accordance with a preferred embodiment of the present invention with the barrier in a deployed position showing net, tower and transport means components of the system.

Referring now to FIGS. 1 and 2, which are respectively a rear (on the side of the net away from oncoming vehicle traffic to be stopped) and a side elevation, a restraining system 10 constructed in accordance with the present invention is illustrated. First and second towers 3 and 4 have lower ends mounted in footings 5 and 6 on either side of a roadway 8.

The towers 3 and 4 each, respectively, support first and second transport means 13 and 14. The transport means 13 and 14 move the barrier means to one of the selectable height positions between fully deployed and fully passive positions, and are slideably mounted to said first and second towers 3 and 4 respectively along guides 15 and 16. The guides 15 and 16 can comprise rollers or molybdenum disulfide impregnated nylon slippers. While Teflon® (tetrafluoroethylene fluorocarbon polymers) is more slippery, it may be too soft to be useful. The transport means 13 and 14 are driven by a stationary electric motor 20 (FIG. 1) with reduction gearing (not shown) between motor 20 and drive sprocket 21 for moving the transport means 13 and 14 to the selectable vertical position. Housing means 17 and 18 surround each transport means in the manner illustrated in FIG. 5, discussed below.

A fixed housing 20A attached to one of the towers, say 4, and the tower per se accommodate a motor 20, drive gear wheel 21 and passive gear sprockets 23 for a chain-drive or the like within the tower. A top crossing structure 10A connects upper portions of the towers 3 and 4 and also transmits motion from a drive side tower to a slave side tower via chain drive or other drive means known per se. One example would be a shaft S mounted within housing 20A on spaced bearings therein (not shown) and linking top pulleys of separate elevating chain drives (22, 22') of the two towers for coordinated motion where one such drive is positively driven by a motor and the other is driven via the shaft (alternatively, electrically synchronized motors could be provided for separate chain drives or the like in each tower). Thus the transport means 13 and 14 move simultaneously and are maintained in vertical registration. Such drive arrangements are well known per se in the art. A barrier means 30, also referred to as a restraining barrier, is provided for placement in a selectable position. In FIG. 1, the barrier means 30, described below, is in a deployed position at the roadway. The means 30 can be raised up to an elevated (passive) position shown in phantom at 30' or higher, preferably wholly within structure 10A for weather protection.

The restraining barrier 30 is preferably a rectangular net of a high strength plastic material (e.g. of Kevlar or of metal). It is supported for positioning at a selected vertical level, when deployed, between said first and second towers 3 and 4. The barrier 30 is suspended from the transport means 13 and 14 and is vertically movable therewith. Reflective strips 31 may be placed on the surface of the restraining barrier 30 to face oncoming traffic. Vertically disposed support rods 32 and 33 are attached to each side of the barrier 30. One or more additional support rods can be provided in the middle of the barrier. Some or all of the vertical support rods may extend down to the roadway 8 to support weight of the barrier 30 from the ground and maintain the barrier, as deployed, at a selected height.

Figure 3:
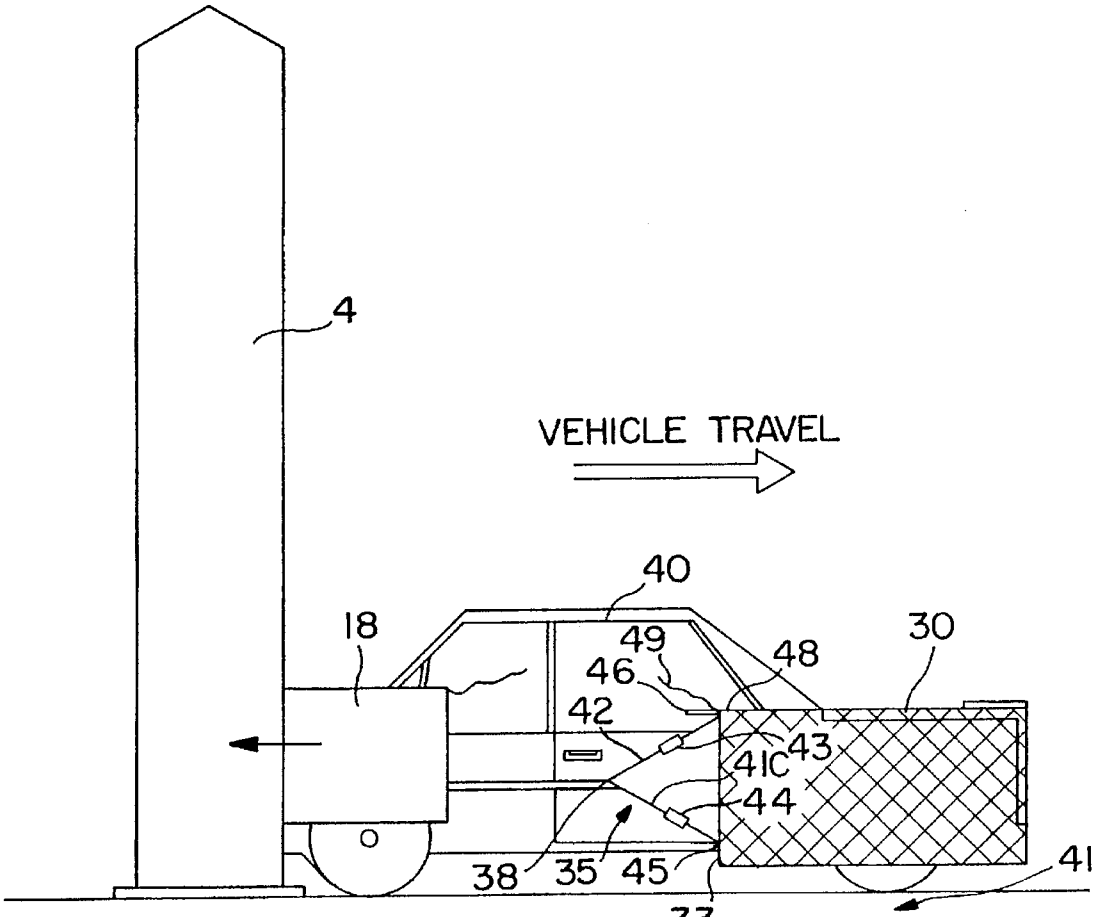
FIG. 3 is a side elevation illustrating a vehicle engaged with the FIG. 1 barrier means in the deployed position, i.e. a vehicle capture event and showing breakage of a cable element of the activation means.

A first selectable position, illustrated in FIG. 1 is one in which the barrier 30 spans the roadway 8 and is vertically positioned to block the path of a vehicle. The vehicle 40 is illustrated in FIG. 3, which is a side elevation illustrating the system and a vehicle engaging the barrier means 30. This first selectable position, illustrated in FIGS. 1 and 3, is referred to in the present description as the deployed position. A restraint zone 41 is defined in which the vehicle 40 will be contained. In a second selectable position, referred to as the passive position, the barrier 30 is positioned vertically above the roadway 8 to permit the vehicle 40 to pass through the restraint zone 41 (FIG. 1).

Cable means 34 and 35 each suspend an opposite span end of the barrier 30 to the first and second transport means 13 and 14, respectively. The cable means 34 has its opposite ends connected to the support rod 32 in registration with upper and lower ends of the restraining barrier 30. An intermediate portion of the cable means 34 is supported to the tower 3 by engaging means attached to or forming a part of an energy absorber 37. The engaging portion of the energy absorber may comprise, for example, an eyelet or a roller. Similarly the cable means 35 has opposite ends affixed to the support rod 33 in registration with upper and lower ends of the restraining barrier 30, with an intermediate portion supported to the tower 4 by engaging means attached to or forming a part of an energy absorber 38. The energy absorbers comprise metal tapes T (thick metal strip) on reels within units 37, 38 that passes through dies or rollers as pulled out (by a vehicle crash into the net) to deform the tapes and transfer energy into size configuration and/or metallurgical state changes of the tape, as described in the above cited patents.

A first sensing cable 49 is affixed to one end of the barrier 30 at the support rod 33 and extends to the transport means 14. The sensing cable 49 is coupled to activator means further described below with respect to FIGS. 5 and 6. The sensing cable 49 helps maintain the barrier 30 in its vertical disposition. Similarly, a sensing cable 59 is connected from one end of the barrier 30 at support rod 32 to the transport means 13. The sensing cable 59 is connected to activator means 37 further described below for response to a engagement of a vehicle by the barrier, and also helps to maintain the barrier 30 in its vertical position.

In FIG. 3, the barrier 30 is in the deployed position in a situation in which the barrier 30 has blocked the path of the vehicle 40 in the restraint zone. The barrier 30 has been engaged. The cable assembly 35 has transmitted force to the energy absorber 38 to pull out its tape thereby converting vehicle momentum to tape modification force while the tape is reeled out. A plastically deformed portion of the tape T is visible in FIG. 3. Similarly, the cable 34 has transmitted force to and pulled the plastically deformed metal tape from the energy absorber 37. The sensing cable 49, which was fastened to a substantially nondeformable support point, has broken. On the other side cable 59 has similarly broken. The system can work with one or both of such bends.

Figure 4:
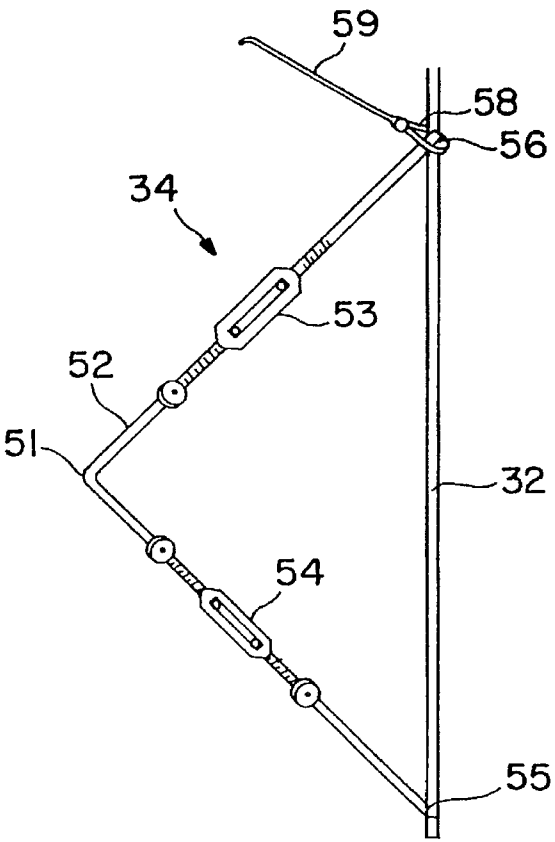
FIG. 4 is a partial, detailed view illustrating in greater detail cable means supporting the barrier means of said embodiment.

FIG. 4, a partial detailed view, further illustrates the connections of cable assembly 34 (also representative of cable assembly 35) to the barrier 30 for restraining the vehicle 40. The cable means 34 includes a cable 52 having a central portion 51 for engaging the energy absorber 37. The cable 52 includes turnbuckles 53 and 54 for adjusting the length of the cable 52 on either side of the central portion 51. The sensing cable 59 is affixed to an upper portion of the support rod 32 by a tie or loop 58 at a junction 56. At the junction 56, the loop 58 may go around the end of the cable 52 where it is affixed to the support rod 32. Similarly, as seen in FIG. 3, the cable means 35 includes a cable 42 having a central portion 41 for engaging the energy absorber 38. The cable 42 includes turnbuckles 43 and 44 for adjusting the length of the cable 42 on either side of the central portion 41. The sensing cable 49 is affixed to an upper portion of the support rod 33 by a tie or a loop 48 at a junction 46. At the junction 46, the loop 48 may go around the end of the cable 42 where it is affixed to the support rod 33.

Figure 5:
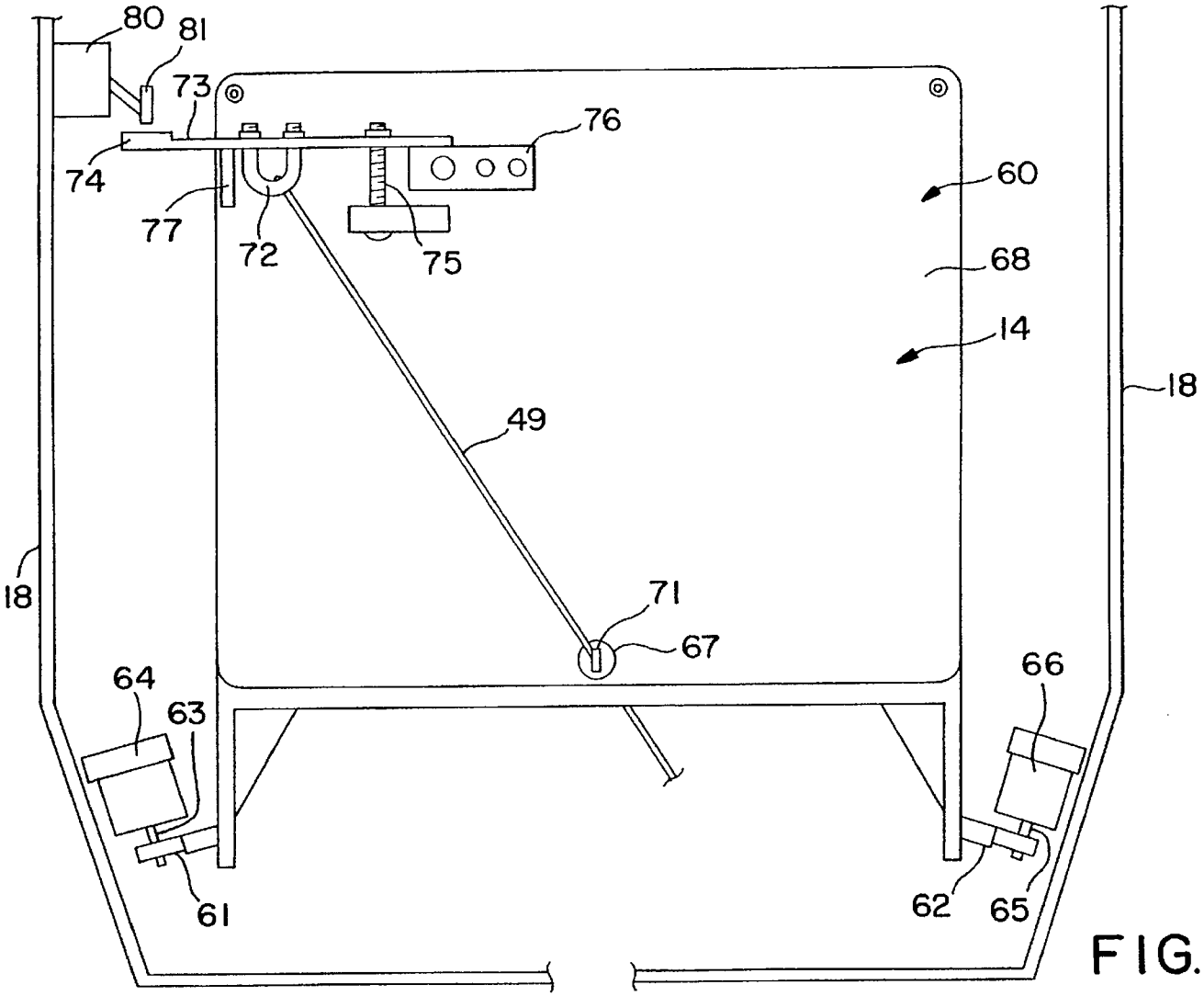
FIGS. 5 and 6 are partial detailed plan and elevation views illustrating the relative positions of activator and indicating means in the transport means and the tower respectively when the barrier is in the deployed position.
Figure 6:
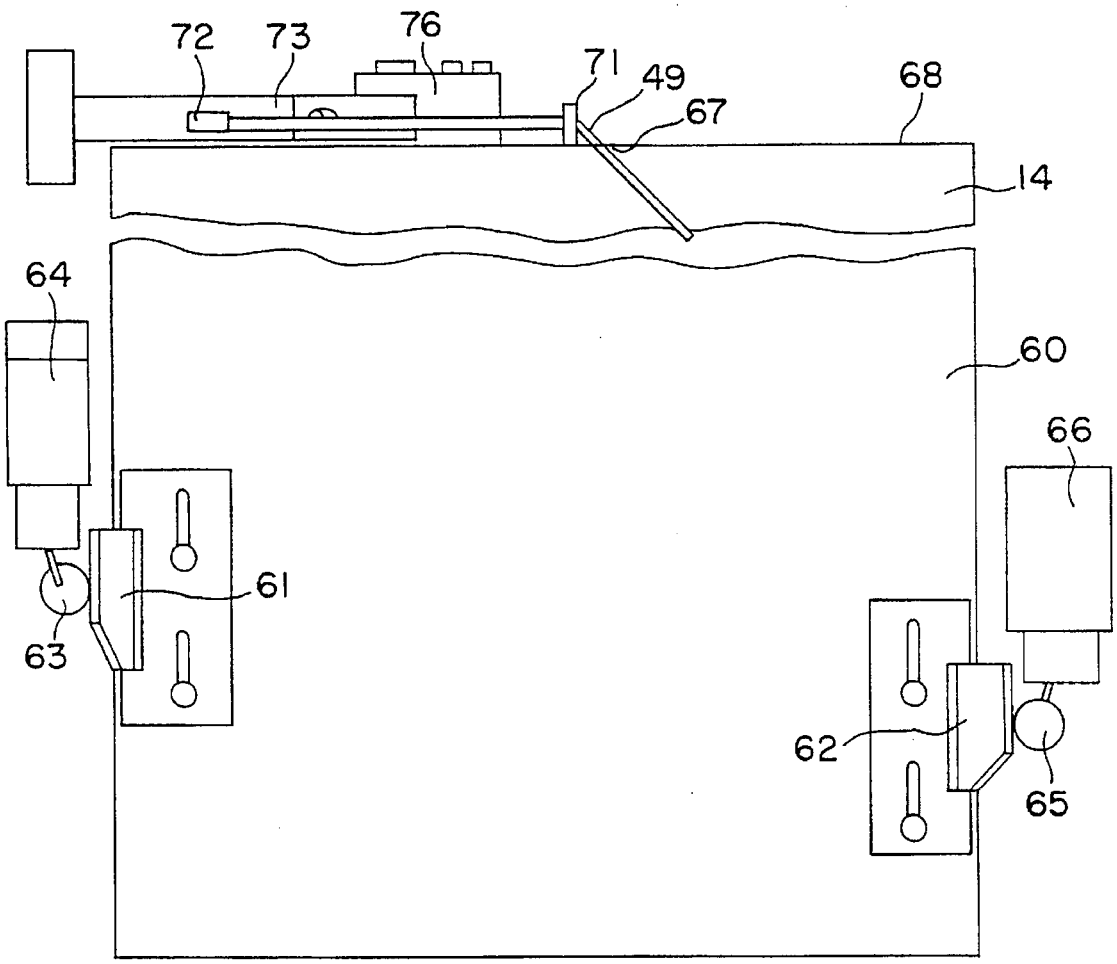
Figure 7:
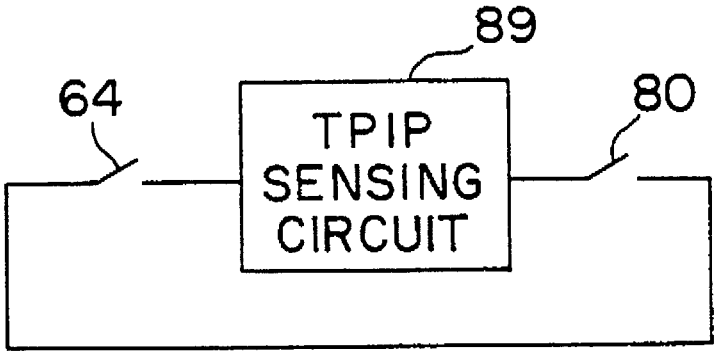
FIG. 7 is a partial, detailed view illustrating operation of the vehicle capture indicating means.

The sensing cable 59 is connected to the activator means, as further described with respect to FIGS. 5 and 6 as well. FIGS. 5 and 6 are partial detailed plan and elevation views illustrating the juxtaposition of activator and indicating means in the transport means 13 and 14 and the towers 3 and 4, respectively, when the barrier 30 is in the deployed position. While these figures illustrate the components in the tower 4, they are illustrative of the entire system in that the arrangement in the tower 3 may be the mirror image of FIGS. 5 and 6. FIG. 7 is a diagram further illustrating indicating means. FIG. 7 further illustrates control circuitry 89 which may be in the tower 4 or coupled to switch means 64 (described below) from a remote location.

The transport means 14 comprises a carriage 60 having a platform 68. An arm 61 projects from the carriage 60 for engaging an activator arm 63 of a limit switch 64 mounted to the tower 4. For further reliability, a second arm 62 projects from the carriage 60 for engaging an activator arm 65 of a limit switch 66 mounted to the tower 4. The limit switches 64 and 66 sense when the carriage 60 is in a vertical position corresponding to the deployed position of the barrier 30. The outputs of the switches 64 and 66 are each connected in accordance with desired control functions.

An end of the sensing cable 49 is illustrated which is secured to the transport means 14 (FIG. 1). The cable 49 extends over a bearing surface 71 through an aperture 67 in the platform 68 of the carriage 60 and out of a cover wall of tower 4 via a gasket lined opening. The end of the cable 49 is connected at a tie point 72 to activator means 73, comprising a lever arm, and also referred to as the arm 73. A supported end of the arm 73 is connected to a pivot 76. The cable 49 pulls the arm 73 to rest against stop means 77. A free end of the arm 73 comprises a switch engaging pad 74. Biasing means in the form of a coil spring 75 urges the arm 73 away from the stop means 77. However, the biasing force of the spring 75 is selected to be insufficient to overcome the force applied through the cable 49 urging the arm 73 against the stop means 77. A limit switch 80 is mounted to the tower 4 and has a contact-operating activator arm 81 mounted in registration with the path of the switch engaging pad 74.

In response to a collision, as illustrated in FIG. 3, the cable 49 breaks. Consequently, there is no force counteracting the spring 75. The spring 75 urges the arm 73 so that the pad 74 engages the activator arm 81 to operate the switch 80. The control circuitry 39 produces an output in correspondence with the state of the switch 64. The output of the circuitry 39 may comprise local or remote alarms, and may also perform other desired control functions, including—e.g.—a telephone and an auto-dialer to report a vehicle restraint incident to a remote maintenance headquarters.

Figure 8:
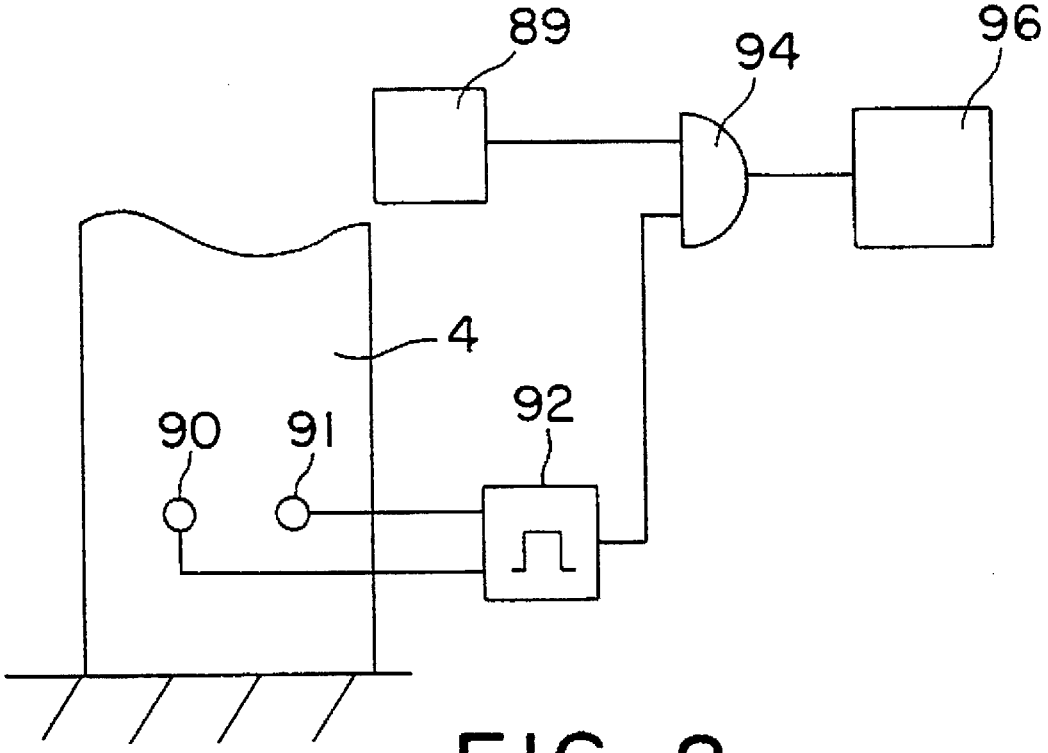
FIG. 8 is a partial, detailed view of an alternative form of means for detecting engagement of a vehicle by the barrier.

FIG. 8 is a partial, detailed view of one tower, e.g. the tower 4 comprising alternative, or additional means for sensing motion of an object in excess of a preselected speed through the restraint zone 41. First and second conventional photosensors 90 and 91 are included in a sensor system 92. The sensors 90 and 91 are mounted for sensing the presence of an object within the line of sight of each photosensor. The sensors 90 and 91 are mounted within a vertical range for sensing motion at a level expected to correspond to that of a passing vehicle, nominally 20 inches up from road grade. There are many applications in which a range of zero to four feet will have utility. The sensor system utilizes conventional circuitry and produces a signal when the sensors 90 and 91 sequentially sense the presence of an object within a preselected period of time. The horizontal spacing between the sensors 90 and 91 is a function of many factors, such as that of the timing circuitry in the sensor system 92 to sense how long it takes for a vehicle to reach from a point in line with the sensor 90 to a point in line with the sensor 91. One convenient distance is three feet. This distance between the sensors 90 and 91 becomes a known constant. By relating the time difference between production of a response at each sensor to this distance, speed of a vehicle passing the sensors 90 and 91 may be easily calculated. The sensors could be used either to calculate actual speed or to sense whether a particular threshold is exceeded. An output from the photosensor system 92 could replace or be combined with the output from the limit switch 80 (FIGS. 5–7).

FIG. 8 further includes a block diagram of circuitry useful in implementing the present invention. A schematic illustration is not provided since the block diagram and teachings of the operation herein will readily disclose the necessary structure to those skilled in the art. A sensing circuit 89 is illustrated which receives an input enabled by the limit switch 80. The output state of the sensing circuit 89 changes when the circuit that includes limit switch 80 provides an output indicative of a collision. The output of sensing circuit 89 is connected to AND gate means 94. The sensor circuit 92 is connected to another input of the AND gate means 94. When the sensors 90 and 91 sense entry of a vehicle 40 into the restraint zone 41 at a level of at least the predetermined velocity, the sensing circuit 92 provides an output indicative thereof to the gate 94. Upon coincidence of the indicated signals at the inputs to the gate 94, an output is provided to operate crash indicator means 96. As noted above, the indicator means may comprise a local alarm and, for remote monitoring, may further comprise telephone, radio or other communication means pending the signal to a remote maintenance facility.

The above described structure will allow many hundreds to thousands of deployments and retractions of the barrier, without a crash incident.

But the sensing structure is not disturbed by the many normal deployments/retractions and remains in readiness to operate reliably to send a signal when a crash does occur. The sensing structure will not give false alarms in response to the roadway vibrations of truck traffic, vehicles slowly moving up to a deployed net or other non-crisis situations. This reliability that assures availability, but avoids false triggering, avoids needles down time (and traffic tie-ups) at grade crossings and the like.

The foregoing specification has been written with a view toward enabling those skilled in the art to construct many different forms of crash detection and indication systems in accordance with the present invention.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A restraining barrier system including means for indicating the status of restraining barrier comprising:

(a) first and second vertically disposed towers, having a restraint zone defined between the lower portions thereof, (b) a crossing structure substantially horizontally disposed between and connected to corresponding upper portions of said first and second towers, (c) first and second transport means slidably mounted in said first and second towers respectively, (d) drive means for moving said transport means to selectable vertical positions, and wherein:

(1) each of said transport means comprises energy absorbing means, a restraining barrier for support between said first and second transport means and being vertically movable therewith, (2) cable means for supporting opposite ends of said barrier means to said first and second transport means and for coupling said end of said barrier means to an energy absorbing means, said selectable positions including a deployed position in which said restraining barrier blocks the path of travel of a vehicle through the restraint zone and a passive position in which said restraining barrier is positioned vertically in the vicinity of said crossing structure above the restraint zone so as to permit a vehicle to pass therethrough, the improvement comprising:

(e) at least one sensing cable means coupling an end of said barrier means to at least one of said first transport means, (f) indicator means for indicating operation of said barrier means for restraining a vehicle, (g) activator means for operating said indicator means, said activator means comprising an element coupled to said sensing cable means such that said activator means is impeded by said sensing cable means from operating said indicator means and said activator means being operated in response to breaking of said sensing cable means in a crash event.

2. The system of claim 1 wherein said indicator means is disposed in one of said tower means and wherein said activator means is positioned for operation when said barrier is in the deployed position.

3. The system of claim 2 wherein said indicator means comprises a spring biased arm and a limit switch.

4. The system of claim 3 further comprising further cable means coupling an opposite end of said barrier means to the other of said transport means and second actuation means in said other transport means.

5. The system of claim 4 further comprising position indicating limit switch means and position activator means on each of said transport means, said position limit means and said position activator means being relatively positioned such that said position activator means operate said position indicating limit switch means when said barrier is in said deployed position, said indicator means and said position limit means being connected such that both said position limit means and said indicator means must be operated to enable an indication of operation of said barrier.

6. A restraining barrier system including means for indicating the status of a restraining barrier comprising: first and second vertically disposed towers, having a restraint zone defined between the lower portions thereof, first and second transport means mounted for vertical movement with respect to said first and second towers respectively, drive means for moving said transport means to selectable vertical positions, at least one of said transport means comprising energy absorbing means, a restraining barrier for support between said first and second transport means and being vertically movable therewith, means for supporting said barrier means to said first and second transport means and for coupling said end of said barrier means to an energy absorbing means, said selectable positions including a deployed position in which said restraining barrier blocks the path of travel of a vehicle through the restraint zone and a passive position in which said restraining barrier is positioned vertically above the restraint zone so as to permit a vehicle to pass therethrough, sensing cable means coupling an end of said barrier means to said first transport means, indicator means for indicating operation of said barrier means for restraining a vehicle, activator means for operating said indicator means, said activator means being coupled to sensing cable means such that said activator means is impeded by said sensing cable means from operating said indicator means and said activator means being operated in response to breaking of said sensing cable means when said barrier impedes a vehicle.

7. A restraining barrier system including means for indicating the status of restraining barrier comprising: first and second vertically disposed towers, having a restraint zone defined between the lower portions thereof, first and second transport means slidably mounted to said first and second towers respectively, drive means for moving said transport means to selectable vertical positions, a least one of said transport means comprising energy absorbing means, a restraining barrier for support between said first and second transport means and being vertically movable therewith, means for supporting said barrier means to said first and second transport means and for coupling said barrier means to an energy absorbing means, said selectable positions including a deployed position in which said restraining barrier blocks the path of travel of a vehicle through the restraint zone and a passive position in which said restraining barrier is positioned to permit a vehicle to pass therethrough, sensing cable means connected between said barrier and a fixed point, whereby said cable means is broken by a vehicle collision of a with said barrier in a deployed position, motion sensing means operable upon sensing entry of a vehicle into said restraining zone at least a predetermined velocity, indicator means for indicating operation of said motion sensing means, activator means for operating said indicator means, said activator means being coupled to said motion sensing means such that said activator means is impeded by said sensing cable from operating said indicator means and said activator means moves to operate said indicator means in response to breaking of said sensing cable, and said indicator means being enabled in response to operation of said motion sensing means.

* * * * *